United States Patent [19]

Lorenz

[11] 4,084,740

[45] Apr. 18, 1978

[54] TWO-PIECE SHIPPING CONTAINERS

[75] Inventor: Achim R. Lorenz, Atlanta, Ga.

[73] Assignee: MacMillan Bloedel Limited, Vancouver, Canada

[21] Appl. No.: 654,066

[22] Filed: Feb. 2, 1976

[30] Foreign Application Priority Data

Nov. 14, 1975 Canada ..... 239712

[51] Int. Cl.[2] ..... B65D 13/04; B65D 5/32

[52] U.S. Cl. ..... 229/23 R; 229/15; 229/44 R; 229/DIG. 1

[58] Field of Search ..... 229/23 R, 23 A, 23 M, 229/15, 44, 45

[56] References Cited

U.S. PATENT DOCUMENTS

| | | | |
|---|---|---|---|
| 3,058,643 | 10/1962 | Wilson | 229/23 R X |
| 3,102,674 | 9/1963 | Hamilton | 229/15 |
| 3,237,841 | 3/1966 | Ridgeway | 229/44 R |
| 3,365,112 | 1/1968 | Priest et al. | 229/23 R |
| 3,713,579 | 1/1973 | Chaffers | 229/44 R |
| 3,829,001 | 8/1974 | Wheeler | 229/15 |

*Primary Examiner*—Davis T. Moorhead

*Attorney, Agent, or Firm*—Sim & McBurney

[57] ABSTRACT

This invention provides a container comprising an inner component and an outer component. The inner component includes a single or double open-ended sleeve of rectangular configuration. The outer component has a rectangular bottom panel, two end panels receivable within the sleeve, and side portions articulated to the other edges of the bottom panel and foldable between a closed position in which they at least partly cover the upper open ends of the sleeve, and an open position in which they uncover the upper open ends of the sleeve.

18 Claims, 7 Drawing Figures

TWO-PIECE SHIPPING CONTAINERS

This invention relates to improvements in containers adapted to carry a large assortment of goods, and especially adapted for repeated use.

The containers to which this invention is generally directed are conventionally configured in the shape of a rectangular parallelepiped, and appear rectangular when seen in elevation, in side view, or in top or bottom plan. It is to be understood, however, that the principle of this invention may be applied to containers having shapes other than that just mentioned.

The prior art containers in the general area contemplated by this invention are typically assembled from one or more stamped and creased blanks made of a suitable panel-providing sheet material such as corrugated cardboard and the like. Typically, the blanks are cut or stamped in such a way as to define a number of articulated panels, tabs and so forth, and these are then folded into the appropriate positions to set up the container in condition for use.

Numerous prior art containers exhibit structure too weak to permit transportation of high density items, and have tended to break down under repeated use and handling.

This invention therefore contemplates the provision of a container with superior characteristics in terms of strength, resistance to wear and rough handling, capability for repeated use, and ready opening and closing without being significantly weakened.

Accordingly, this invention provides a container comprising: an inner component including a plurality of panels interconnected to define an open-ended sleeve member of rectangular configuration, and an outer component which includes a rectangular bottom panel, two end panels articulably connected at opposite edges of said bottom panel and receivable within said respective sleeves, and side portions articulably connected at the other two edges of said bottom panel, each side portion being foldable between a closed position in which it covers at least partly the upper open end of said sleeve member and retains the sleeve member against said bottom panel, and an open position in which it uncovers the upper open end of said sleeve member.

Two embodiments of this invention are illustrated in the accompanying drawings, in which like numerals denote like parts throughout the several views, and in which.

Figure 1:
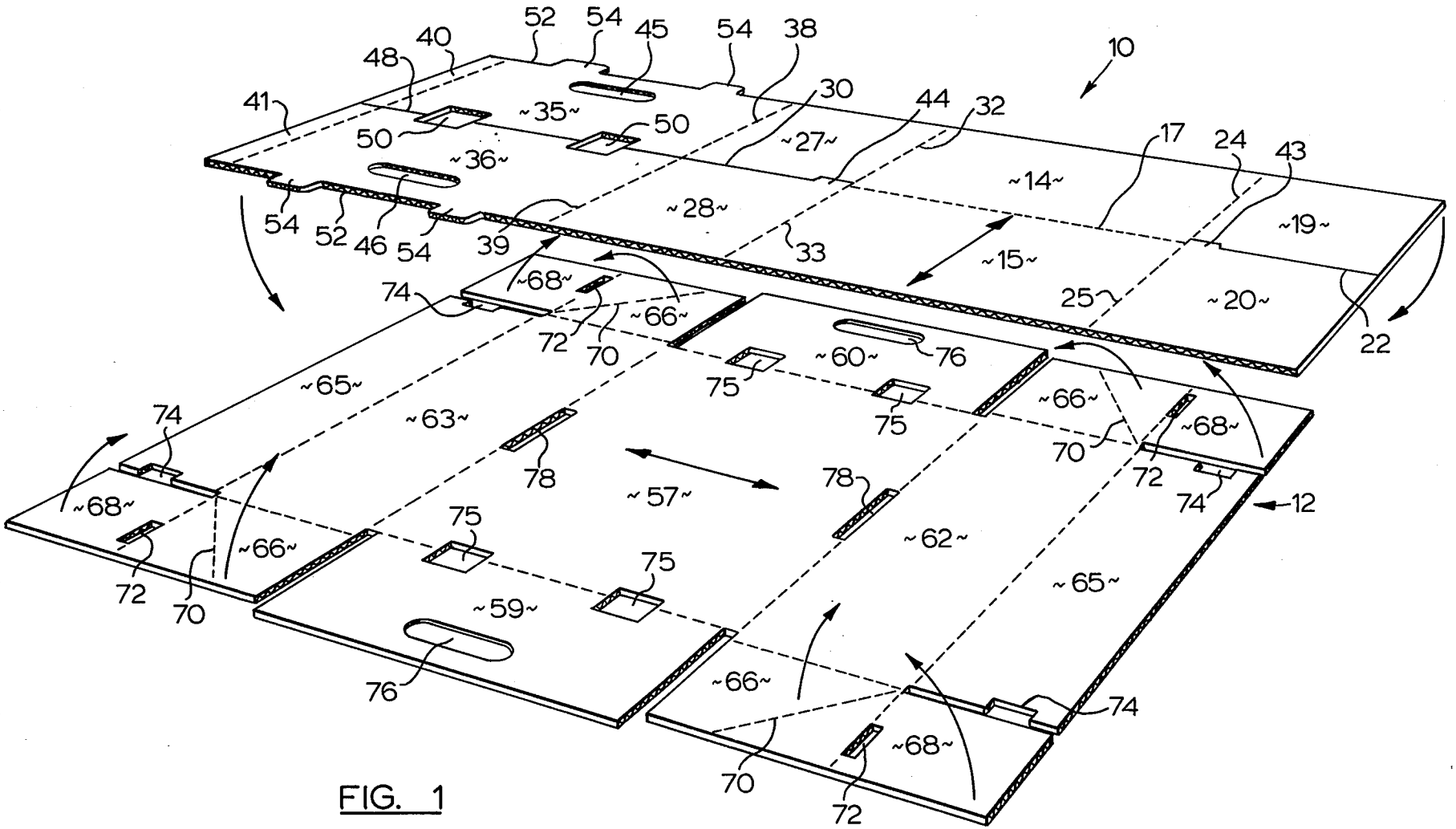
FIG. 1 is a perspective view of two component blanks prior to folding, constituting the first embodiment of this invention.

Altention is first directed to FIG. 1, which shows a first blank 10 and a second blank 12.

As can be seen, the first blank 10 is substantially rectangular in configuration, and it is to be understood that it would be constructed of a sheet material such as corrugated cardboard, suitably cut and scored to define the different panels, flaps and tabs now to be described.

The blank 10 includes two rectangular wall panels 14 and 15 which are articulated together along a common edge 17 which may be defined by a scoreline, a partial perforation, or the like. The wall panels 14 and 15 are substantially of the same size. Two partial side panels 19 and 20 are severed from and independent of each other as indicated by the solid line 22, but are articulated respectively to aligned and adjacent edges 24 and 25 of the wall panels 14 and 15 respectively. The edges 24 and 25 are perpendicular to the common edge 17 between the wall panels 14 and 15. The first blank 10 includes two further partial side panels 27 and 28 which are also severed from and independent of each other as shown by the solid line 30, but are articulated respectively to aligned and adjacent edges 32 and 33 of the wall panels 14 and 15 respectively, the edges 32 and 33 being opposite the edges 24 and 25, respectively.

The first blank 10 further includes two end panels 35 and 36 which are severed from each other but articulated respectively to the partial side panels 27 and 28 at adjacent and aligned edges 38 and 39, respectively, the edges 38 and 39 being on the opposite sides of the partial side panels 27 and 28 from the edges 32 and 33, respectively.

Means are provided for joining the first-mentioned two partial side panels 19 and 20 to the two end panels 35 and 36, this means being particularly illustrated in FIG. 1 as glue flaps 40 and 41 articulated to edges of the end panels 35 and 36 remote from the edges 38 and 39 respectively.

As can be seen, the lines of severance identified by the numerals 22 and 30 include an offset to define projecting tabs 43 and 44 extending from partial side panels 20 and 28, respectively. Also seen in FIG. 1 are handhold apertures 45 and 46 centrally located in the end panels 35 and 36, respectively. The adjacent but unconnected edges of the end panels 35 and 36 defined by the solid line 48 each have two spaced recesses which in the configuration of FIG. 1 appear to define two rectangular openings 50 lying across the line 48. The edge 52 of each end panel 35 and 36 remote from the line of severance 48 has two projecting tabs 54 extending outwardly therefrom.

Attention is now directed to the second blank 12, which is suitably cut and scored to define a rectangular bottom panel 57, two end panels 59 and 60 articulably connected at opposite edges to the bottom panel 57, and two side panels 62 and 63 articulably connected to the bottom panel 57 along the other two edges thereof. All of the articulating connections between panels 59, 60, 62 and 63 and the bottom panel 57 are defined by conventional scorelines, lines of partial severance, or the like. All of the panels 59, 60, 62 and 63 are of substantially rectangular configuration. Each of the side panels 62 and 63 is articulably connected along an edge remote from the rectangular bottom panel 57 to a partial top panel 65, and is articulably connected at the other two opposite edges to a pair of closure flaps 66. There are also provided four glue flaps 68, one being articulably connected to each of the closure flaps 66, the edge of the articulating connection being normal to the edge of the respective closure flap which is connected to the respective side panel.

As can be seen, each closure flap 66 is scored or partially severed obliquely along a line meeting the corner of the closure flap which is closest to the respective partial top panel 65. These oblique scorelines are identified in each case by the numeral 70.

At the line of articulation between each glue flap 68 and its respective closure flap 66 is an aperture 72 which is elongated in the direction of the edge of the articulation. Each of the opposite side of each partial top panel 65 has a substantially rectangular recess 74.

There are two rectangular apertures 75 lying athwart each of the edge articulations between the bottom panel 57 and the end panels 59 and 60 at spaced locations along these edges. Also, each of the end pnels 59 and 60 has a hand-hold aperture 76.

Finally, the bottom panel 57 has two intermediate elongated apertures 78 located mid-way of each of the articulating edges between the bottom panel 57 and each of the side panels 62 and 63.

Figure 2:
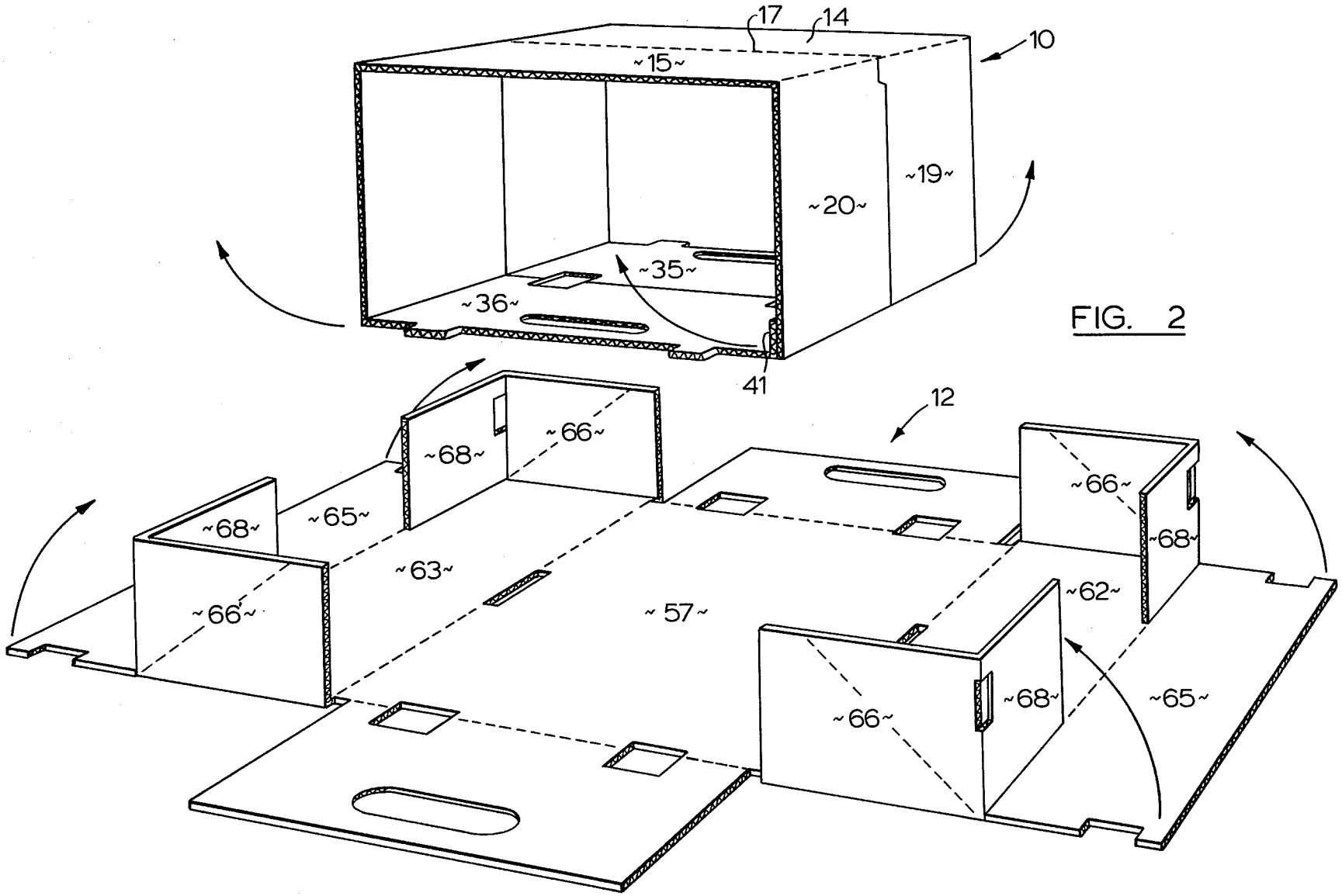
FIG. 2 is a perspective view of the blanks of FIG. 1, showing initial folding steps.

Attention is now directed to FIG. 2, which illustrates the initial folding step for both of the blanks 10 and 12 in the process of constructing the container of this invention.

As seen at the top in FIG. 2, the ends of the upper blank 10 are brought downwardly and then together in order to form a rectangular sleeve shape, with the end panels 35 and 36 in the lowermost position, the wall panels 14 and 15 in the uppermost position, and the glue flaps 40 and 41 glued to the bottom edges (the bottom in FIG. 2) of the partial side panels 19 and 20.

FIG. 2 shows the second blank 12 in a configuration in which each of the glue flaps 68 has been folded at right angles to its respective closure flap 66, and each closure flap has been in turn folded at right angles to its respective side panel 62, 63. This brings the glue flaps 68 into a position aligned with the edge articulation between each side panel 62, 63 and the respective partial top panel 65.

Figure 3:
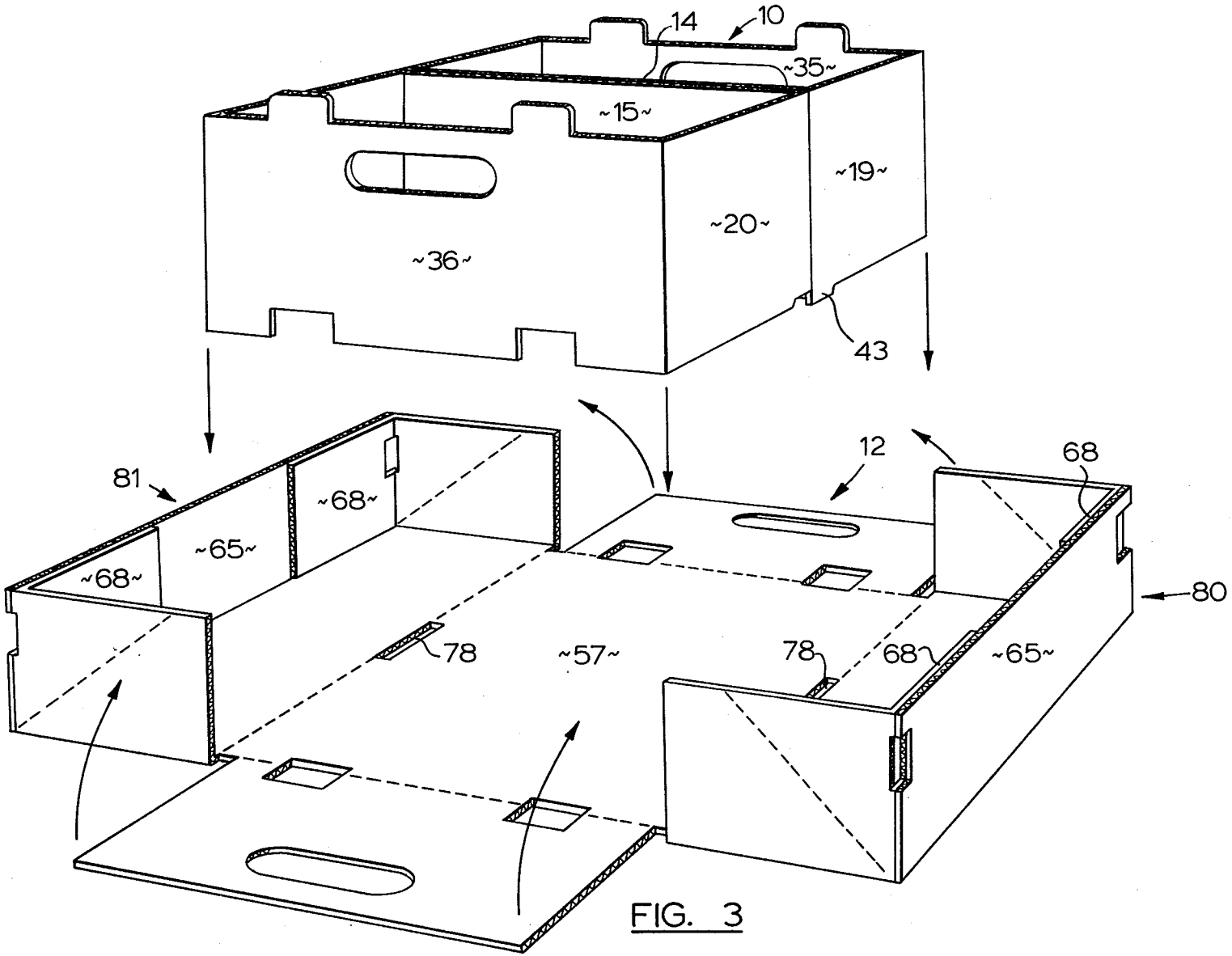
FIGS. 3, 4 and 5 illustrate additional folding steps.

Attention is next directed to FIG. 3, which shows the blank 10 in its next configuration, which results from rotating the different components thereof about the common edge 17 between the wall panels 14 and 15. The large curved arrows in FIG. 2 show the direction of rotation, and the end result is to bring the two wall panels 14 and 15 together into face-to-face juxtaposition, with their free edges uppermost. This in turn brings the end panel 36 to a position closest to the viewer in FIG. 3, and the end panel 35 furthest from the viewer in FIG. 3.

Figure 4:
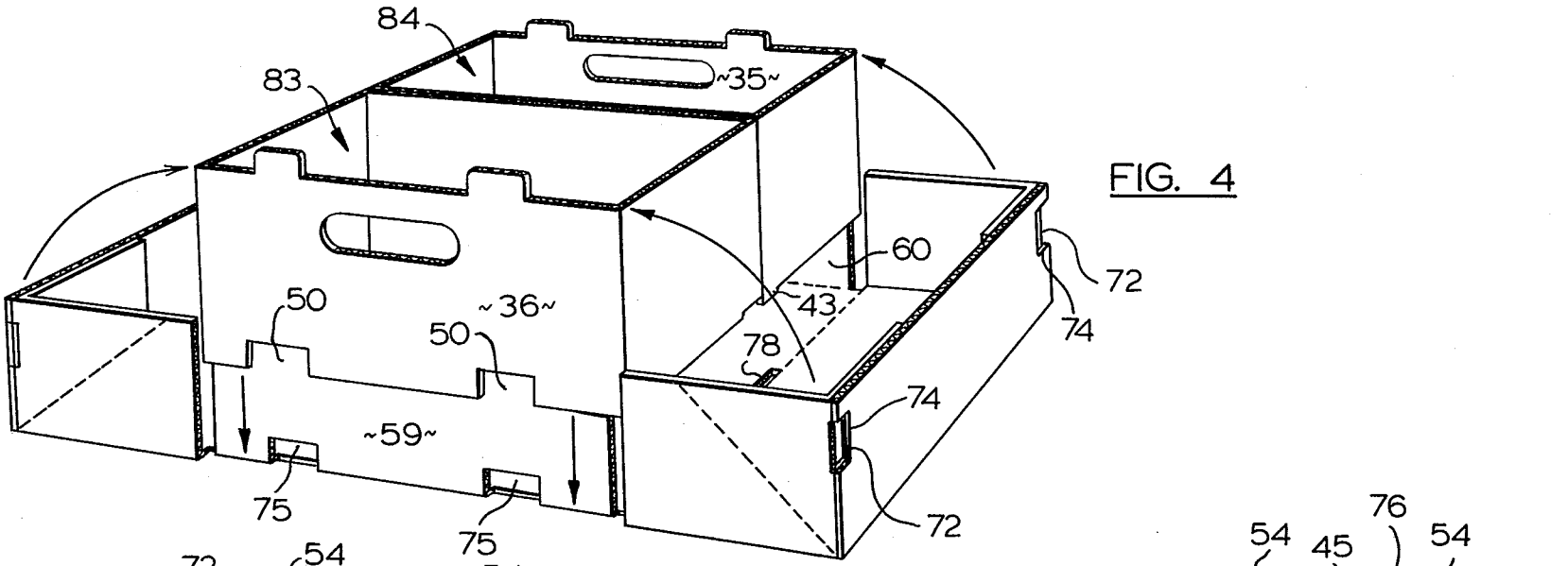

Also in FIG. 3, the blank 12 has been shown in its next position, which involves folding the partial top panels 65 through 90° to bring them in face-to-face juxtaposition with the respective glue flaps 68. The partial top panels 65 are then glued in this position. The result of this operation is to provide what may be defined as side portions shown generally by the numerals 80 and 81 which can be considered to be articulably connected to opposite edges of the bottom panel 57. These side portions 80 and 81 are then foldable between open and closed position as will hereinafter be explained. The open position of the side portion is that shown in FIG. 3. Attention is now directed to FIG. 4 which shows the partial assembly of the two components together to form the container of this invention. Prior to the position shown in FIG. 4, the end panels 59 and 60 of the second blank 12 are folded up into the vertical position at right angles to the bottom panel 57. This is shown by the large arrows in FIG. 3. In this vertically oriented position, the end panels 59 and 60 can be received inwardly of the end panels 36, 35 respectively of the first component (made from the first blank 10), as the latter moves downwardly as shown by the heavy arrows in FIG. 4. It is convenient to consider the component constructed from the first blank 10 to be an inner component which includes two open ended sleeves 83 and 84, each of the sleeves consisting of four panels in rectangular configuration. Thus, the end panels 59 and 60 of the component made from the second blank 12 can be considered to be receivable within the respective sleeves 83, 84, as seen in FIG. 4. The component made from the second blank 12 can thus be considered to be an outer component.

Figure 5:
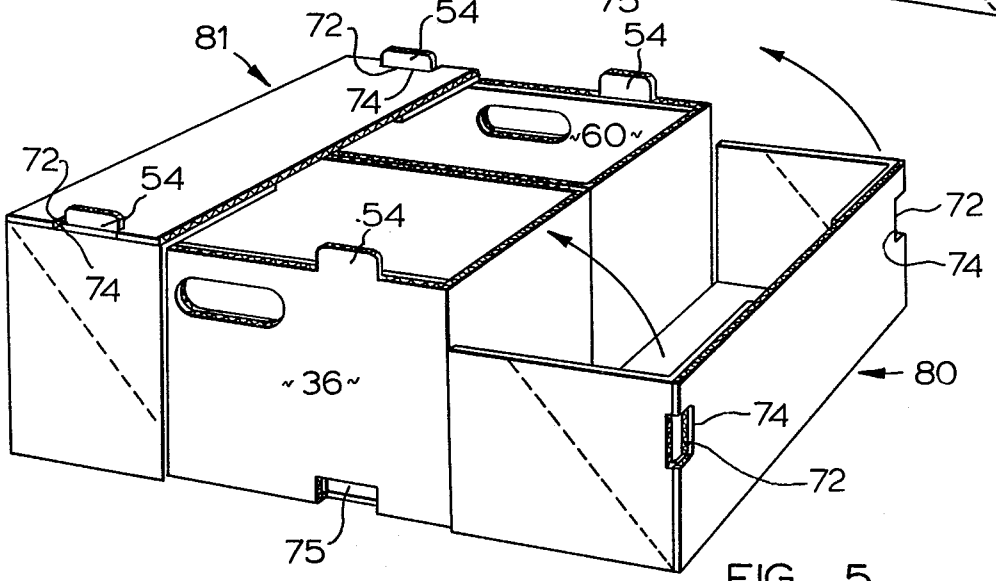

FIG. 5 shows the inner component (made from the first blank 10) to be in its lowermost position with respect to the outer component (made from the second blank 12). In this fitted condition, the tabs 43 and 44 are received within the apertures 78, and the respective positions of the end panels 59 and 60 within the sleeves 83 and 84 result in a "locking together" of the two components when fitted together as seen in FIG. 5.

FIG. 5 also shows the side portion 81 (forming a part of the second or outer component) folded up into operative engagement with the left side and top of the inner component made from the first blank 10. As can be seen, each of the openings defined by the registry of one of the apertures 72 with the respective recess 74 coincides spacially with the appropriate one of the tabs 54 of the first comonent, and the tab projects through the opening in order to provide a "snap-fit" to maintain the side portion in its closed position, the closed position being that shown in FIG. 5. In FIG. 5, the other side portion 80 is still in its open position, but the large arrows show the direction of folding to bring the side portion 80 into the closed position.

Figure 6:
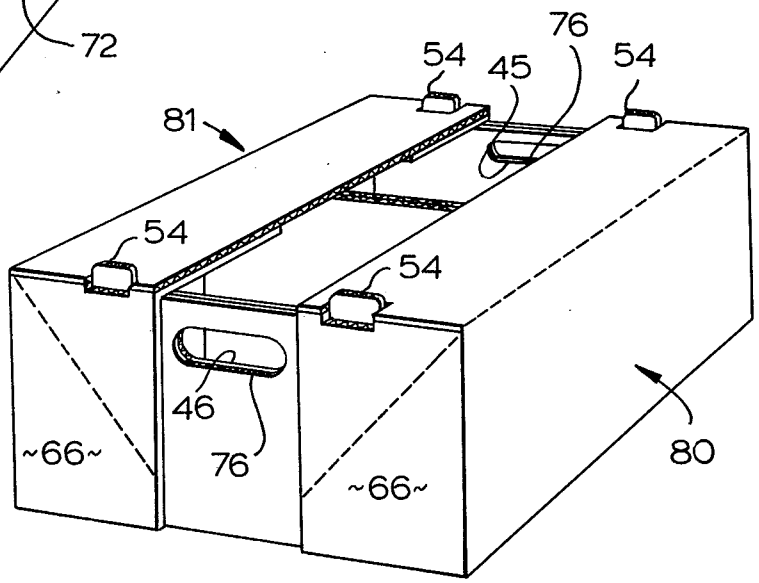
FIG. 6 is a perspective view of a completed, closed container in accordance with this invention.

In FIG. 6, both side portions 80 and 81 are illustrated in the closed position.

As can be seen, the hand-hold apertures 76 of the outer component are provided in such a way as to register with the corresponding hand-hold apertures 45, 46 of the inner component.

As best seen in FIGS. 4 and 5, the apertures 75 in the outer component (made from the second blank 12) are positioned vertically beneath the respective tabs 54, and this provides a stacking feature by which another identical container may be positioned on top of the one shown in FIG. 6 in closed position, with the tabs 54 of the container shown in FIG. 6 received in the apertures 75 of the container next above. The apertures 75 are not visible in FIG. 6, being covered by the closure flaps 66.

Figure 7:
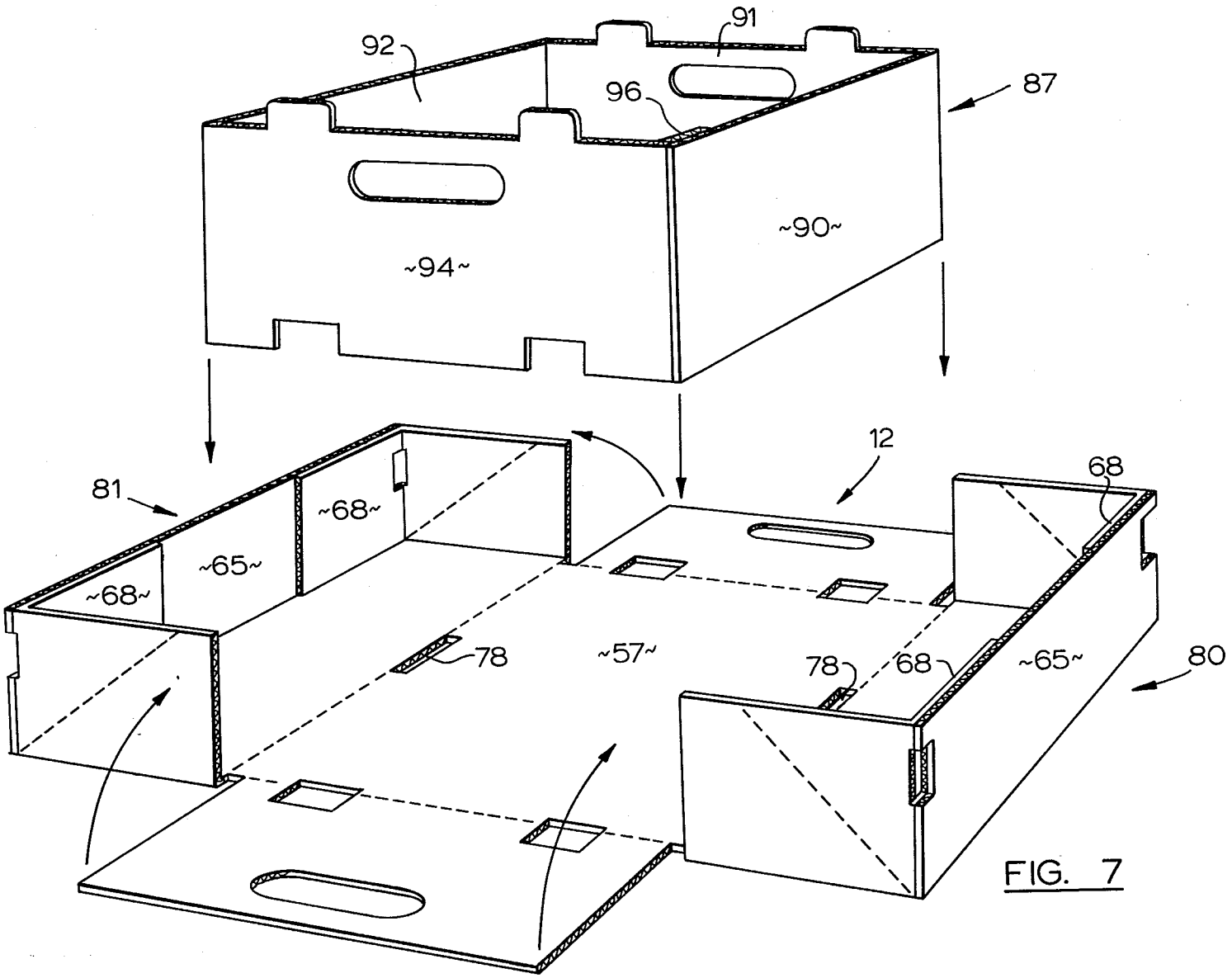
FIG. 7 is a view similar to FIG. 3, showing the second embodiment of this invention.

Attention is now directed to FIG. 7, which illustrates the second embodiment of the invention. In FIG. 7 the lower component is identical in all respects to the lower component made from the blank 12 described in connection with the first embodiment of this invention shown in all of the other figures. For this reason it is not necessary to repeat any of the previous description.

The upper component 87 in FIG. 7 can be considered to be an inner component similar to the inner component made from the first blank 10 described in connection with the first embodiment of this invention. The construction of the component 87, however, differs from that of the inner component forming a part of the first embodiment of this invention. As can be seen the component 87 defines an open-ended sleeve which is not a double sleeve as in the first embodiment, but is simply a single sleeve which includes a first side panel 90, a first end panel 91, a second side panel 92 and a second end panel 94. These panels would be formed as a single blank sequentially defining the panels, with sequentially adjacent panels being articulably integral along scorelines or crease lines, all of which lines would be parallel. Means are provided for joining the first side panel to the second end panel, these means being particularly shown in FIG. 7 as a glue flap 96 which is articulably integral with the rightward end of the second end panel 94, and which is glued against the inside of the first side panel 90.

The fitting together and the locking of the two components shown in FIG. 7 is identical to the steps illustrated for the first embodiment in FIGS. 3–6. Due to this similarity of assembly, it is not considered necessary to repeat the same description a second time.

What I claim is:

1. A container, comprising:

an inner component including a plurality of panels interconnected to define an open-ended sleeve member of rectangular configuration, and an outer component which includes a rectangular bottom panel, two end panels articulably connected at opposite edges of said bottom panel and receivable within said respective sleeves, and side portions articulably connected at the other two edges of said bottom panel, each side portion being foldable between a closed position in which it covers at least partly the upper open end of said sleeve member and retains the sleeve member against said bottom panel, and an open position in which it uncovers the upper open end of said sleeve member.

2. The invention claimed in claim 1, which further includes snap means for retaining said side portions in said closed positions.

3. The invention claimed in claim 1, in which the inner component includes two open-ended sleeves, each with four panels in rectangular configuration, a panel of one sleeve being juxtaposed against a panel of the other sleeve and articulably connected thereto along a common edge.

4. The invention claimed in claim 3, in which the common edge along which the two juxtaposed panels are connected is located against said bottom panel when said side portions are in their closed positions.

5. The invention claimed in claim 1, in which the inner component has four rectangular panels articulated together.

6. The invention claimed in claim 1, in which each said side portion includes a side panel articulably connected to the bottom panel, a partial top panel normal to said side panel and adapted to partly cover the upper open end of said sleeve member, and rigidifying structure retaining said partial top panel normal to said side panel.

7. The invention claimed in claim 6, in which said rigidifying structure includes two closure flaps articulably connected to opposite ends of said side panel, and two glue flaps each articulably connected to an edge of a respective closure flap, said last-mentioned edge being normal to the closure flap edge connected to the side panel, each glue flap being glued to an end portion of the partial top panel defining at either end an opening adapted to register with an upwardly projecting tab on the sleeve member.

8. The invention claimed in claim 7, in which the common edge along which the two juxtaposed panels are connected is located against said bottom panel when said portions are in their closed positions.

9. In combination:

a first substantially rectangular blank of sheet material being suitably cut and scored to define two rectangular wall panels articulated together along a common edge, two partial side panels severed from each other but articulated respectively to first adjacent edges of said wall panels, said first adjacent edges being normal to said common edge, two further partial side panels severed from each other but articulated respectively to second adjacent edges of said wall panels opposite said first adjacent edges, two end panels severed from each other but articulated respectively to said further partial side panels at further adjacent edges opposite said second adjacent edges, and means for joining said first-mentioned two partial side panels to said two end panels respectively, and second substantially rectangular blank of sheet material being suitably cut and scored to define a rectangular bottom panel, two end panels articulated respectively to opposite edges of said bottom panel, two side panels articulated respectively to the other two edges of said bottom panel, each side panel having a top edge opposite the edge of articulation with the bottom panel and two end edges, two partial top panels articulated to the respective top edges of the side panels, four closure flaps two of which are articulated to the respective end edges of each side panel, and four glue flaps, each glue flap being articulated to a respective closure flap along an edge normal to the respective end edge and remote from the bottom panel.

10. The combination claimed in claim 9, in which the end panels of the second blank each have a hand-hold aperture centrally located therein.

11. The combination claimed in claim 9, in which there is an elongated aperture at the articulation between each glue flap and its respective closure flap, and two rectangular apertures athwart each of the articulations between the bottom panel and the end panels at spaced locations therealong, the opposite ends of each partial top panel being recessed, there being two projecting tabs extending from parallel but remote edges of said end panels of said first blank.

12. The combination claimed in claim 9, in which each closure flap is scored obliquely along a line meeting the corner thereof which is closest to the respective partial top panel.

13. The combination claimed in claim 11, in which the end panels of the second blank each have a hand-hold aperture centrally located therein, and in which each closure flap is scored obliquely along a line meeting the corner thereof which is closest to the respective partial top panel.

14. In combination:

a first substantially rectangular blank of sheet material being suitably cut and scored to define sequentially a first side panel, a first end panel, a second side panel and a second end panel, sequentially adjacent panels being articulated integrally together along a score line, all score lines being parallel, and glue flap means for articulably joining said first side panel to said second end panel to define a rectangular open-ended sleeve member, and a second substantially rectangular blank of sheet material being suitably cut and scored to define a rectangular bottom panel, two end panels articulated respectively to opposite edges of said bottom panel, two side panels articulated respectively to the other two edges of said bottom panel, each side panel having a top edge opposite the edge of articulation with the bottom panel and two end edges, two partial top panels articulated to the respective top edges of the side panels, four closure flaps two of which are articulated to the respective end edges of each side panel, and four glue flaps, each glue flap being articulated to a respective closure flap along an edge normal to the respective end edge and remote from the bottom panel.

15. The combination claimed in claim 14 in which the end panels of the second blank each have a hand-hold aperture centrally located therein.

16. The combination claimed in claim 14, in which there is an elongated aperture at the articulation between each glue flap and its respective closure flap, and two rectangular apertures athwart each of the articulations between the bottom panel and the end panels at spaced locations therealong, the opposite ends of each partial top panel being recessed, there being two projecting taps extending from parallel but remote edges of said end panels of said first blank

17. The combination claimed in claim 14, in which each closure flap is scored obliquely along a line metting the corner thereof which is closest to the respective partial top panel.

18. The combination claimed in claim 16, in which the end panels of the second blank each have a hand-hold aperture centrally located therein, and in which each closure flap is scored obliquely along a line meeting the corner thereof which is closest to the respective partial top panel.

* * * * *